United States Patent [19]

Giannotti

[11] Patent Number: 4,768,776

[45] Date of Patent: Sep. 6, 1988

[54] ROWING EXERCISE MACHINE EXTENSION

[76] Inventor: Anthony Giannotti, 169 Quarry Rd., Stamford, Conn. 06903

[21] Appl. No.: 31,413

[22] Filed: Mar. 30, 1987

[51] Int. Cl.[4] ..... A63B 69/06

[52] U.S. Cl. ..... 272/72; 272/DIG. 4; 272/120

[58] Field of Search ..... 272/72, 114, 70.3, 133, 272/DIG. 4, 120, 121, 127; 297/271; 280/87.05, 224

[56] References Cited

U.S. PATENT DOCUMENTS

| | | | |
|---|---|---|---|
| 541,857 | 7/1895 | Hinton et al. . | |
| 787,676 | 4/1905 | Kelly | 297/271 X |
| 1,247,869 | 11/1917 | Ostlin . | |
| 1,625,447 | 4/1927 | Benice . | |
| 1,715,870 | 6/1929 | Spain . | |
| 2,397,054 | 3/1946 | Segalla . | |
| 3,112,108 | 11/1963 | Hanke . | |
| 3,261,606 | 7/1966 | Elia et al. | 272/72 |
| 3,473,843 | 10/1969 | Hart . | |
| 3,770,267 | 11/1973 | McCarthy | 272/72 X |
| 3,834,726 | 9/1974 | Hobza | 280/87.05 X |
| 4,477,071 | 10/1984 | Brown et al. | 272/72 |
| 4,563,000 | 1/1986 | Gall | 272/72 |
| 4,627,610 | 12/1986 | Ishida et al. | 272/72 |

FOREIGN PATENT DOCUMENTS

| | | | |
|---|---|---|---|
| 117960 | 10/1969 | Norway | 272/72 |
| 117935 | 8/1918 | United Kingdom | 272/72 |
| 466901 | 6/1937 | United Kingdom | 272/72 |

*Primary Examiner*—Richard J. Apley
*Assistant Examiner*—David J. Bender
*Attorney, Agent, or Firm*—Kramer, Brufsky & Cifelli

[57] ABSTRACT

An exercise extension device is provided which is adapted to attach to existing rowing exercise machines allowing the user to exercise while in a fully reclined position. The apparatus comprises a padded platform which attaches behind the seat of the rowing exercise machine so that the user may comfortably change from a sitting to reclining position. Ground-engaging wheels are attached to the rear of the padded platform thereby allowing the exercise extension device to move as the seat of the rowing exercise machine moves. A roller is attached to the front of the padded platform which rides on the same track as the seat of the rowing exercise machine. The roller can be easily adapted to a wide variety of existing designs of rowing exercise machines. Further, the height of the roller and the ground-engaging wheels are adjustable in order to adapt to a wide variety of existing rowing machines.

The exercise extension device is attached to the seat of the rowing exercise machine by the use of cables which loop around the supporting structure of the seat and are clamped into secure positions, thus enhancing the universal adaptability of the apparatus.

The exercise extension device permits a variety of exercises to be conducted including a fully extended rowing exercise, sit-ups and leg-pushes.

11 Claims, 6 Drawing Sheets

ROWING EXERCISE MACHINE EXTENSION

BACKGROUND OF THE INVENTION

1. Field of the Invention

This invention relates to an apparatus which may be connected to a conventional rowing exercise machine thereby allowing the rowing exercise machine user to increase the range of exercises which may be performed to include exercises in which the user reclines.

2. Description of the Prior Art

Exercising equipment such as rowing machines is well-known and frequently used in private and commercial circumstances. Rowing machines allow the user to exercise his arms, shoulders, chest and legs by simulating the movement required to propel a rowboat. These machines could provide a more complete exercise program if adapted to permit the user to more fully exercise his stomach and thighs. Additionally, it would be desirable for the user to be able to stop and rest in the middle of an exercise without placing himself in an unsafe or uncomfortable position. Further, it would be desirable for individuals who already own a conventional rowing exercise machine to be able to convert his present rowing exercise machine, through an inexpensive attachment, to an exercise machine with which he could perform a variety of exercises. In order to be useful, however, it would be necessary for such an attachment to be adaptable to a variety of existing rowing machine configurations.

U.S. Pat. No. 4,477,071 issued to Brown et al discloses a rowing machine which may be operated in either of two configurations. The first configuration places the force resistive arms into a position causing the machine to simulate a bench-press weight system. The second configuration is that of a rowing machine with a provision for the user to fully recline. However, as the seat of this machine does not move with respect to the leg supports, there is no opportunity to exercise one's thighs during the rowing exercises. Additionally, this machine is an integral unit which does not allow conversion of any number of existing rowing machines into a unit which allows a variety of exercises.

U.S. Pat. No. 1,715,870 issued to Spain discloses a platform upon which one may sit or recline and exercise by pulling a handlebar or pushing pedals which are made force resistive in one direction by the use of elastic rubber members. Such a device does not have a provision for exercising one's waist and thighs in a sit-up configuration as one's legs extend over the platform to the pedals without any securing means. Moreover, staying in a stationary position pulling on an elastic loaded handlebar and pusing on elastic loaded pedals does not provide the full range of body movements afforded by a modern rowing machine. Additionally, this machine is an integral unit which does not allow conversion of any number of existing rowing machines into a unit which allows a variety of exercises.

SUMMARY OF THE INVENTION

In accordance with the present invention, an exercise extension device is provided which can be easily attached to a variety of rowing exercise machines thereby extending the seat portion of the rowing exercise machine and allowing the user to engage in a range of additional exercises which require full reclining. This enables the user to perform additional exercises benefiting his waist, stomach and thighs. Further, as it may be adapted to many existing conventional rowing machines, it provides the consumer these benefits at a low cost.

The exercises which can be accomplished through use of the exercise extension device of the present invention include a basic rowing exercise in which the user goes from a sitting position to a fully reclining horizontal position thereby moving his upper body approximately 110° at the waist instead of the usual 30° associated with a standard rowing machine exercise; sit-ups in which the user goes from a fully reclined position with straight legs to a sit-up position with flexed legs thereby moving his body horizontally and exercising both his waist and thighs; and leg-pushes in which the user remains fully reclined while using his legs to push his body, the seat and the extension device back and forth in a horizontal direction.

In order to allow the exercise extension device of the present invention to move freely following the motion of the seat of a conventional exercise machine, a padded platform is provided with ground-engaging wheels affixed to one end thereof, while at the other end thereof, a wide roller is provided which is adapted to ride on the same rail upon which the seat of the rowing exercise machine moves. This wide roller is adapted to accommodate a wide range of track designs—including double and single tracks—allowing the extension device of the present invention to be used in conjunction with most existing rowing machines. Further, the distances which the wheels and the roller extend from the padded platform are each adjustable so as to maintain the platform in a horizontal position while remaining adaptable to most existing rowing machines. The extension device is secured to the rowing machine seat by the use of cables. These cables have one end permanently fastened to the extension device. The user loops the cables tightly around the supports of the rowing machine seat or around other appropriate structural portions of the rowing machine and clamps the free end of the cable to itself. One end of a safety cable is secured to the extension device, while the other is secured to the rowing machine thereby preventing the extension device from dangerously coming free of the rowing exercise machine should the attaching cables accidentally release during use. The use of cables in this manner allows for quick and simple attachment to virtually any rowing machine without the need for such product-specific provisions as the lining up of bolt holes, and the like.

BRIEF DESCRIPTION OF THE DRAWINGS

The present invention will become apparent from the following description and claims and from the accompanying drawings wherein:

DETAILED DESCRIPTION OF THE PREFERRED EMBODIMENTS

Figure 1:
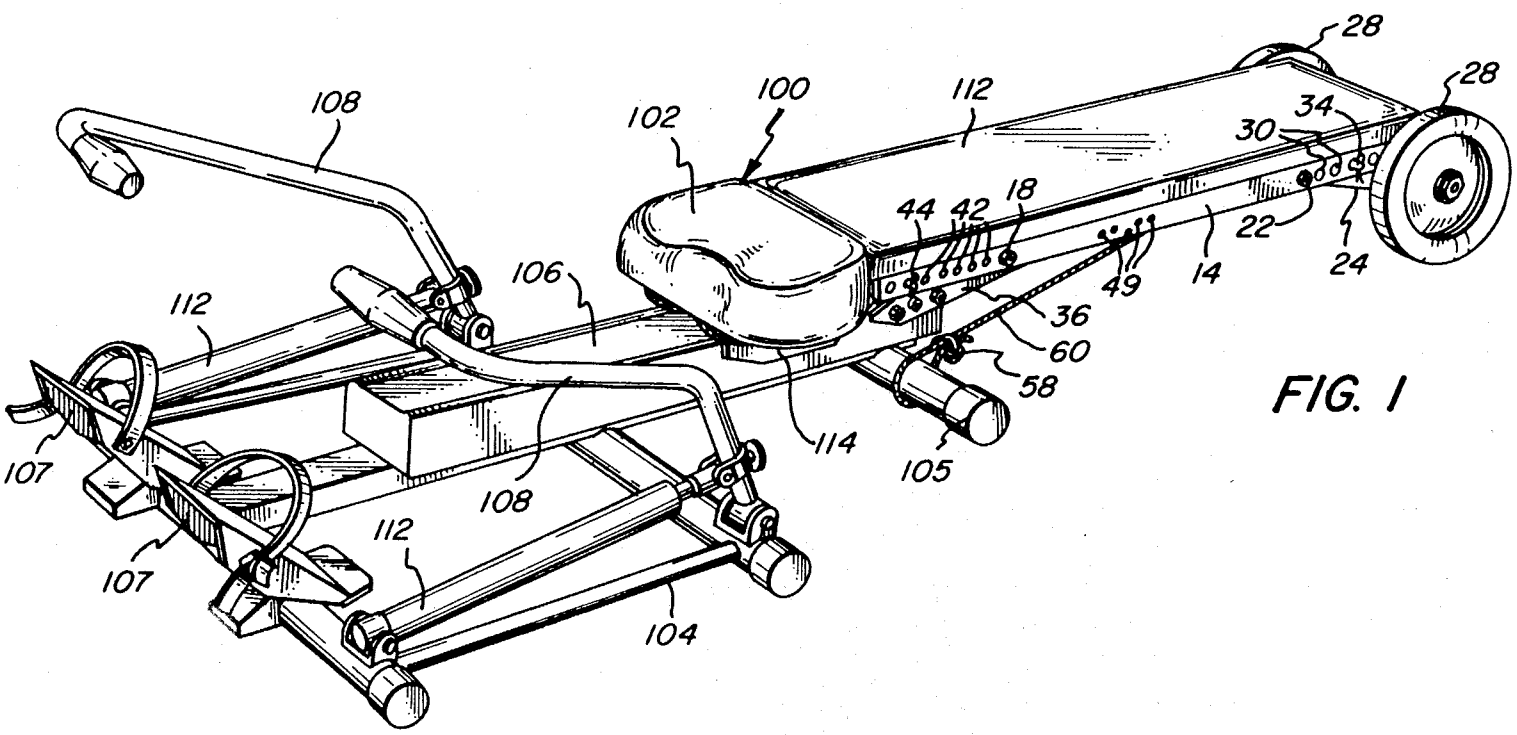
FIG. 1 is a perspective view of the exercise extension device of the present invention attached to a typical rowing exercise machine.
Figure 2:
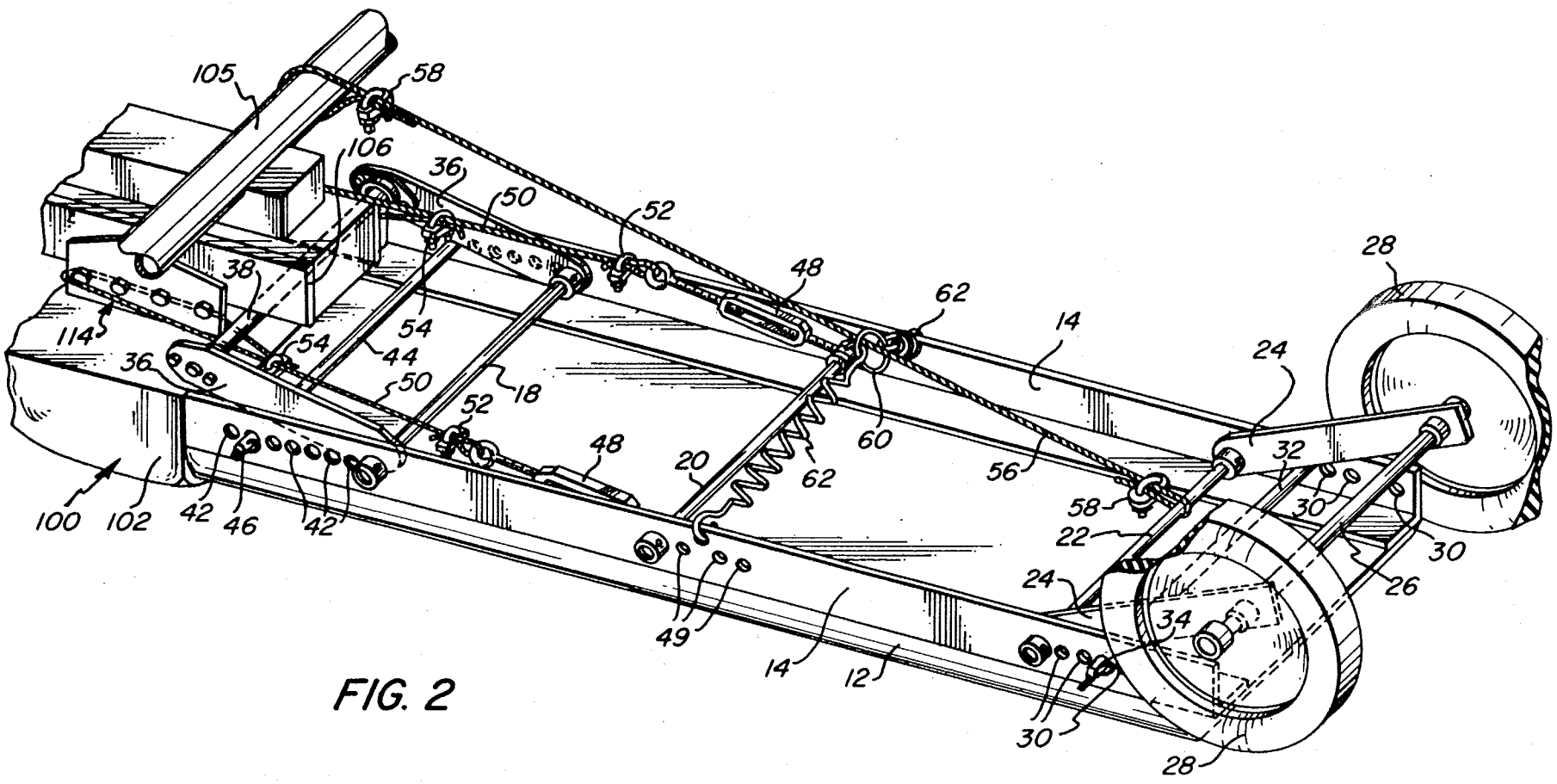
FIG. 2 is a perspective view of the underside of the extension device of the present invention.
Figure 3:
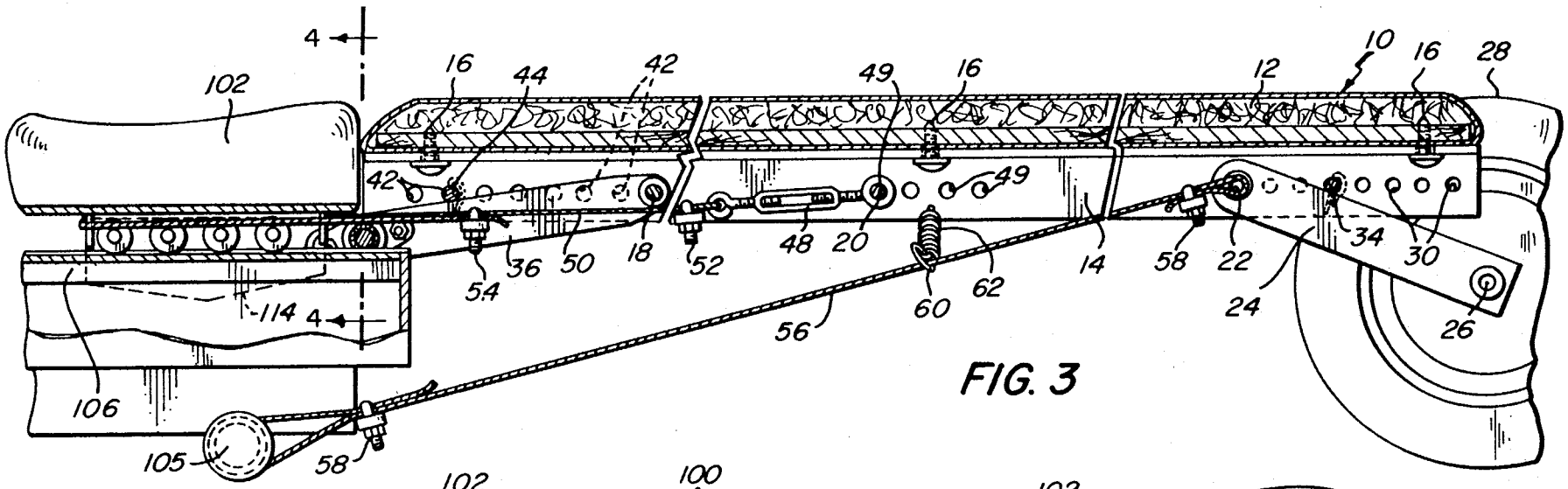
FIG. 3 is a front view in elevation, partly in cross-section, of the present invention attached to a typical rowing exercise machine.

Referring now to the drawings wherein like numerals indicate like elements throughout the several views, the present invention comprises an exercise extension apparatus 10 which is designed to be readily attached to a wide variety of existing rowing exercise machines 100 thereby extending the seat portion 102 providing the user with an opportunity to engage in a variety of exercises in which the user may recline.

A typical rowing exercise machine 100 includes a ground-engaging frame 104 joined to a terminal ground-engaging support 105 by a rail 106. Attached to the ground-engaging frame 104 are foot-rests 107 and force-resistive arms 108. The arms 108 are made force-resistive by hydraulic means 112. A rolling seat support structure 114 rides on the rail 106. A seat 102 is attached to the rolling seat support structure 114. The user sits on seat 102, secures his legs in the footrests 107 and pulls the force-resistive arms 108. As he pulls the force-resistive arms 108, the seat 102 travels along rail 106 in a direction away from the footrests 107. The present invention is an apparatus 10 which, when attached to an existing rowing exercise machine 100, allows the user to engage in a variety of additional exercises in which he can fully recline.

The exercise extension device 10 of the present invention comprises a padded platform 12. The padded platform 12 is supported by two L-shaped support members 14 running parallel to the longitudinal axis of the padded platform 12 and fastened along the longitudinal edges of the under-surface of platform 12 by fastening means 16. These L-shaped support members 14 are spaced apart from each other by a front lateral rod 18, a middle lateral rod 20 and a rear lateral rod 22. Rear lateral rod 22 provides an axis from which wheel support bars 24 pivot. An axle 26 is supported and journaled for rotation between the free ends of wheel support bars 24. The axle 26 supports two ground engaging wheels 28 which are spaced apart at a wider interval than the width of the padded platform 12. Several apertures 30 are cut into the L-shaped support members 14 posterior to the rear lateral rod 22. A rear adjustment rod 32 is inserted through an aperture 30 in one L-shaped support member 14 in a direction parallel to that of the rear lateral rod 22 and through a corresponding aperture 30 in the opposite L-shaped support member 14. The rear adjustment rod 32 can be secured against longitudinal movement by any fastening means such as cotter pins 34. The rear adjustment rod 32 provides a stop against which the wheel support bars 24 may rest. The choice of apertures 30 through which the rear adjustment rod 32 is inserted changes the angle of inclination at which the wheel support bars 24 come to rest thereby adjusting the distance from the padded platform 12 to the ground-engaging wheels 28 allowing the apparatus 10 to remain horizontal at varying heights from the ground.

Front lateral rod 18 provides an axis from which roller support bars 36 pivot. A roller 38 is journaled for rotation on ball bearings 40 held in races 41 between the free ends of roller support bars 36.

Several apertures 42 are cut into the longitudinal axis of the L-shaped support member 14 anterior to the front lateral rod 18. A front adjustment rod 44 is inserted through an aperture 42 in each of the L-shaped support members 14 in a direction parallel to that of the front lateral rod 18. The front adjustment rod 44 is secured against longitudinal movement by fastening means such as cotter pins 46. The front adjustment rod 44 provides a stop against which roller support bars 36 may rest. The choice of apertures 42 through which the front adjustment rod 44 can be inserted changes the angle of inclination at which the roller support bars 36 come to rest thereby adjusting the distance from the padded platform 12 to the roller 38 allowing the apparatus 10 to remain horizontal at varying heights from the ground as required by the height of the seat 102 and the rail 106 of the rowing exercise machine 100.

A pair of turnbuckles 48 are affixed to the opposed ends of the middle lateral bar 20 proximate the points of attachment of said middle lateral bar 20 to L-shaped support member 14. Several apertures 49 are cut into central locations of the longitudinal axis of the L-shaped support member 14. The position of the middle lateral bar 20, and hence the turnbuckles 48, may be changed by the selection of apertures 49 through which the middle support bar 20 is inserted. One end of an attachment cable 50 is attached to each turnbuckle 48 by a clamp 52. The attachment cables 50 loop around seat support structure 114 and are held in place with clamps 54 thereby securing the apparatus 10 to the rowing exercise machine 100.

A safety cable 56 is attached at one end to the rear lateral rod 22 and at the opposed end to terminal ground-engaging support 105 of the rowing exercise machine by clamps 58. The safety cable 56 passes through a metal loop 60 which is held close to the apparatus 10 by springs 62 attached at one end to the L-shaped support members 14 proximate the middle lateral rod 20 and at the other end to the metal loop 60. Metal loop 60 prevents the safety cable 56 from dragging or tangling as the apparatus 10 moves back and forth.

Figure 5:
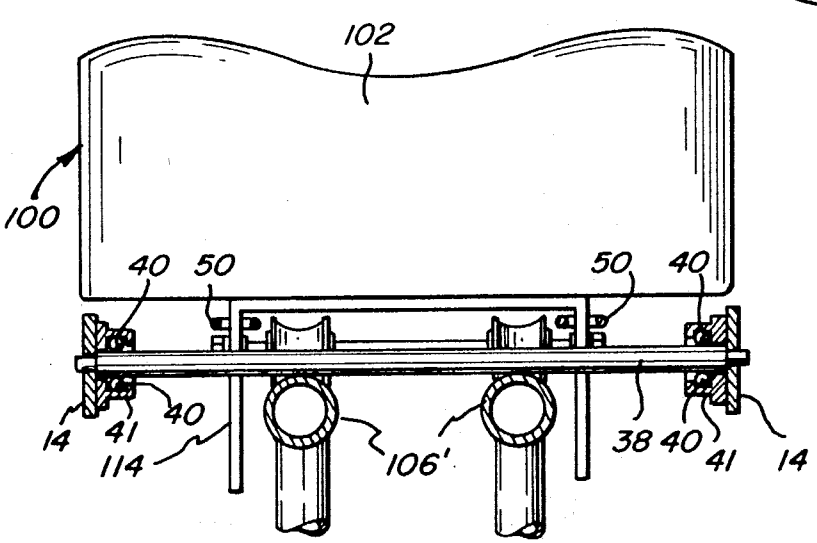
FIG. 5 is a cross-sectional view taken substantially along the plane indicated by line 4—4 of FIG. 3 with the rowing exercise machine shown with a double track.
Figure 4:
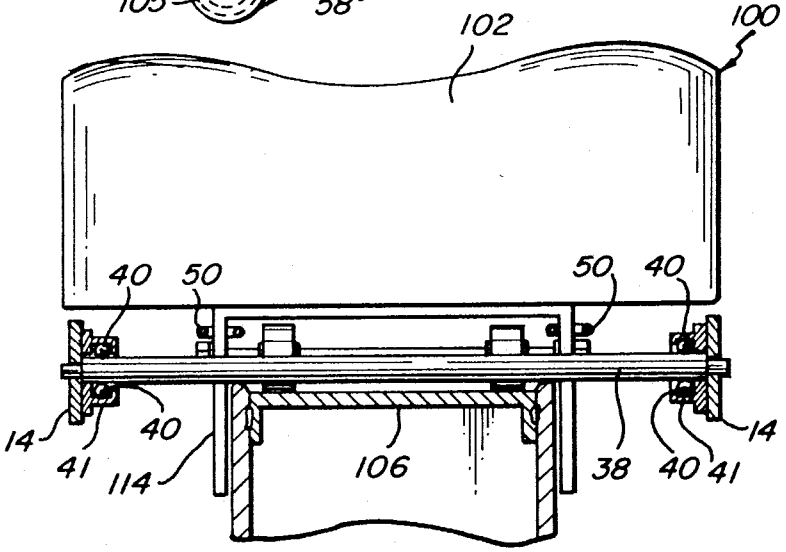
FIG. 4 is a cross-sectional view taken substantially along the plane indicated by line 4—4 of FIG. 3 with the rowing exercise machine shown with a single track.
Figure 6A:
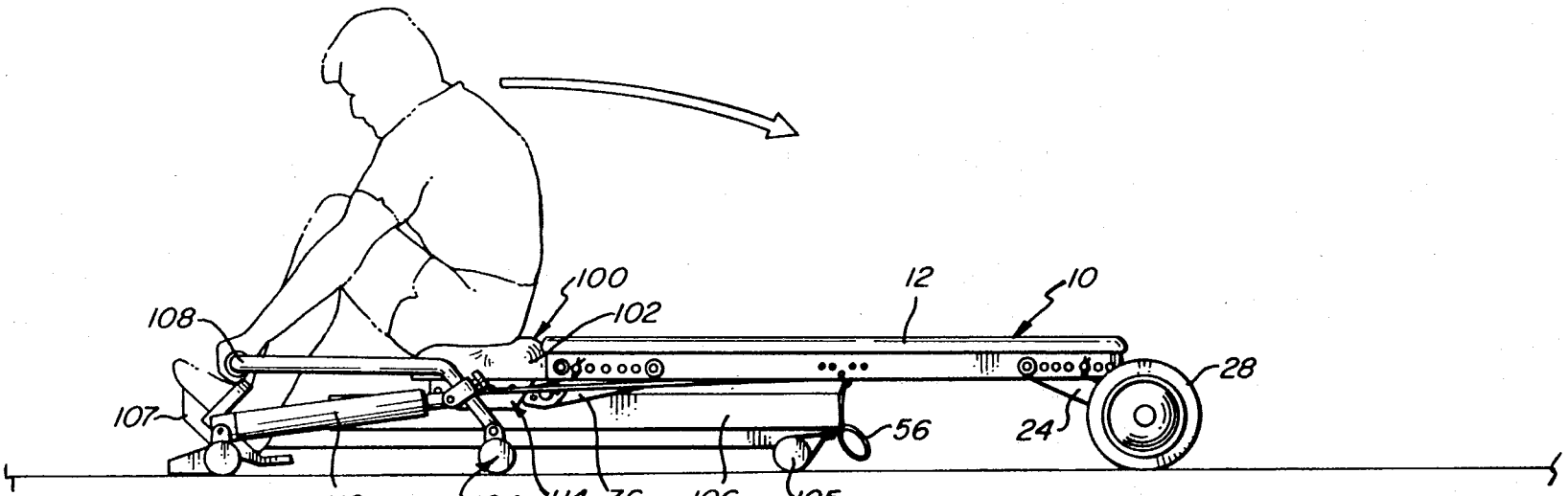
FIGS. 6*a* and 6*b* show the present invention attached to a typical rowing exercise machine being used by a person engaging in a rowing exercise in which he comes to a full reclining position.
Figure 6B:
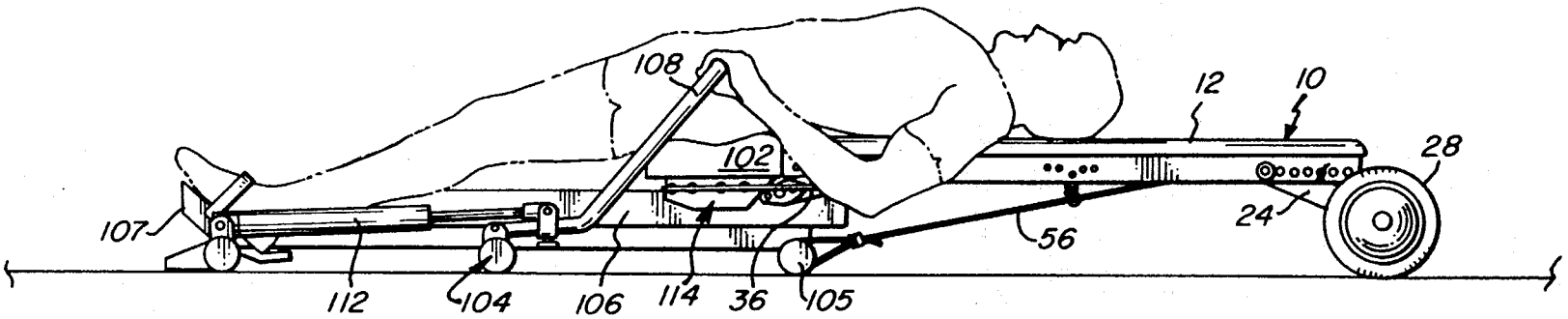
Figure 7A:
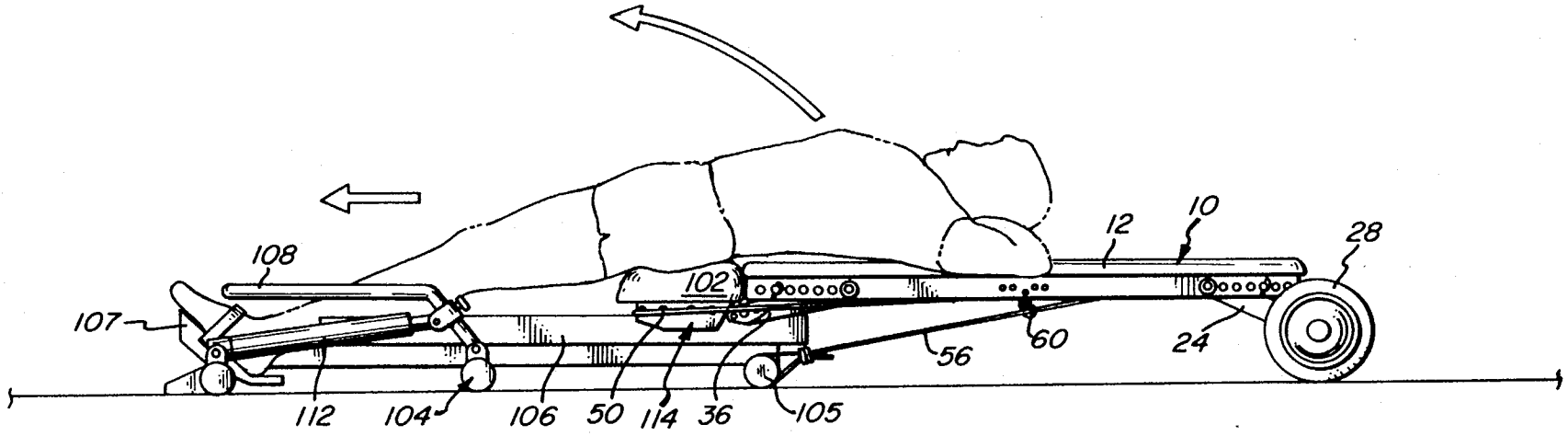
FIGS. 7*a* and 7*b* show the present invention attached to a typical rowing exercise machine being used by a person engaged in sit-up exercises in which he comes to a full reclining position, using his legs to effect horizontal movement of his body and the apparatus.
Figure 7B:
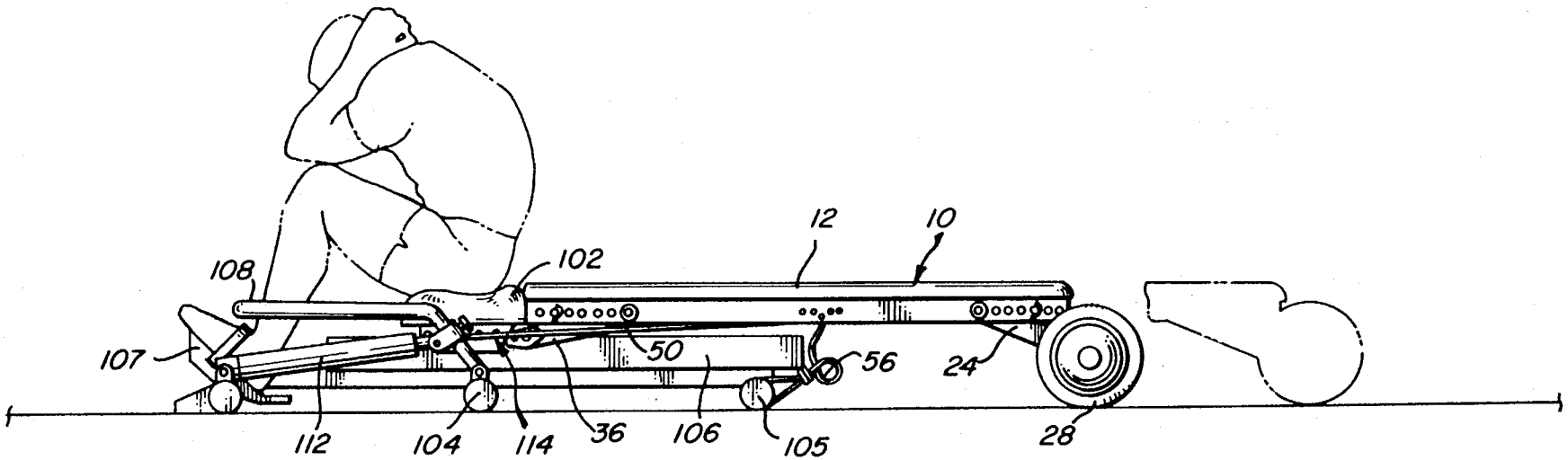
Figure 8A:
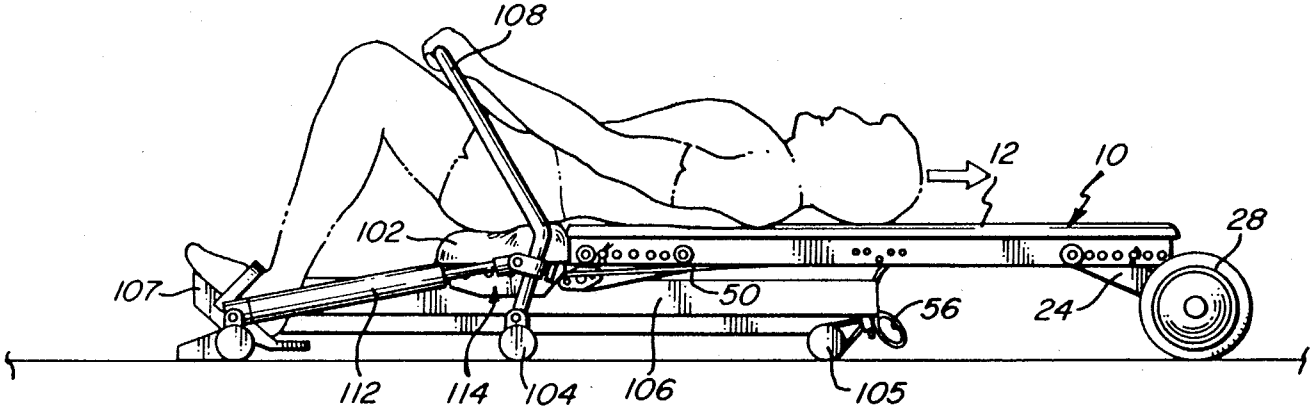
FIGS. 8*a* and 8*b* show the present invention attached to a typical rowing exercise machine being used by a person engaged in a leg-push exercise during which he remains fully reclined.
Figure 8B:
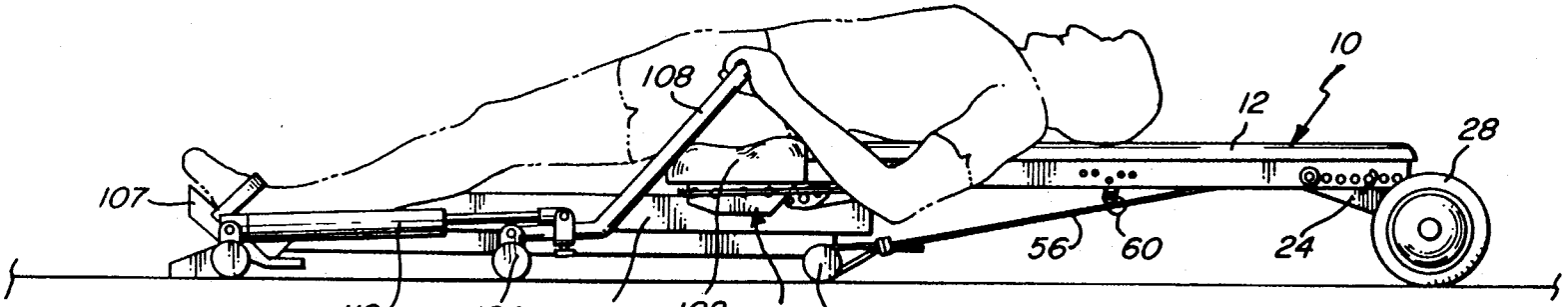

In order to use the exercise extension apparatus 10, one would place the roller 38 on the track 106 of the rowing exercise machine 100. As shown in FIGS. 4 and 5, the roller 38 is designed to be adaptable to a wide variety of track designs, including single tracks 106 (FIG. 4) and double tracks 106 (FIG. 5). In order to provide a comfortable transition from the seat 102 of the rowing exercise machine 100 to the exercise extension apparatus 10, the user adjusts the height of the platform 12 with respect to the roller 38 by changing the angle of inclination of the roller support bars 36. This is accomplished by changing the position of the front adjustment rod 44 against which the roller support bars 36 rest by changing the selection of apertures 42 through which the front adjustment rod 44 is inserted. The front adjustment rod 44 is secured in place by cotter pins 46.

In order to maintain the horizontal inclination of the exercise extension apparatus 10, the user adjusts the height of the platform 12 with respect to the ground-engaging wheels 28 by changing the angle of inclination of the wheel support bars 24. This is accomplished by changing the position of the rear adjustment rod 32 against which the wheel support bars 24 rest by changing the selection of the apertures through which the rear adjustment rod 32 is inserted. The rear adjustment rod 32 is secured in place by cotter pins 34.

The user may adjust the extension of cables 50 either by changing the choice of apertures 49 through which middle lateral rod 20 is inserted, thereby changing the position of middle lateral rod 20 and/or by adjustment of turnbuckles 48. The exercise extension apparatus 10 is attached to the rowing exercise machine 100 by looping cables 50 around the seat support structure 114 of the rowing exercise machine 100, and securing the free end of the cables 50 by use of clamps 54. Additionally, a safety cable 56 is looped around the terminal ground-engaging support 105 of the rowing exercise machine 100. The free end of safety cable 56 is secured at an appropriate length by the use of clamp 58.

This arrangement allows the exercise extension apparatus 10 to form an extension of the seat 102 of the rowing exercise machine 100. The exercise extension apparatus 10 moves freely with the movements of the seat 102, thereby allowing the user to engage in a variety of exercises in which the user can fully recline. These exercises include a basic rowing exercise in which the user goes from a sitting position to a fully reclining horizontal position thereby moving his upper body approximately 110° at the waist, as illustrated in FIGS. *6a* and *6b*, instead of the usual 30° associated with a standard rowing machine; situps in which the user goes from a fully reclined position with straight legs to a sit-up position with flexed legs thereby moving his body horizontally and exercising both his waist and thighs as illustrated in FIGS. *7a* and *7b*; and leg-pushes in which the user remains fully reclined while using his legs to push his body, the seat 102 and the exercise extension apparatus back and forth in a horizontal direction as illustrated in FIGS. *8a* and *8b*.

What is claimed is:

1. An exercise extension device adapted to be attached to a rowing exercise machine, said rowing exercise machine including a rail, a seat, and first rolling support means supporting said seat for longitudinal movement on said rail forwardly and rearwardly, said exercise extension device comprising:

a horizontal platform having a forward portion and a terminal portion longitudinally spaced from said forward portion;

means to affix said forward portion of said horizontal platform adjacent to and behind the seat of the rowing exercise machine to move in concert with the seat; second rolling support means separate from said first rolling support means supporting said seat, for supporting said forward portion of said horizontal platform to move on said rail; and ground-engaging rolling means affixed to said terminal portion of said horizontal platform, further allowing said horizontal platform to move in concert with the seat.

2. The extension device of claim 1 wherein said second rolling support means, distinct from said first rolling support means of the rowing exercise machine supports the platform to roll on the rail of the rowing exercise machine behind said first rolling support means and reduces friction therebetween as said horizontal platform moves with the seat.

3. The extension device of claim 2 further including means to adjust the height of said horizontal platform with respect to said second rolling support means to align said horizontal platform with the seat, the height adjusting means including a support bar having one end attached to said second rolling support means and another end pivotally mounted to said horizontal platform parallel to said rail, an adjustment rod, and a plurality of aperture means for mounting said adjustment rod to said horizontal platform transverse to and above said support bar at a plurality of locations between said other end of said support bar and a forward end of said horizontal platform, said adjustment rod being mounted in one of said aperture means and adapted to provide a stop against which said support bar rests to set the height of said horizontal platform.

4. The extension device of claim 1 further including means to adjust the height of said horizontal platform with respect to said ground-engaging rolling means.

5. The extension device of claim 2 wherein the affixing means includes a cable which secures said forward portion of said horizontal platform adjacent to said seat of said rowing exercise machine.

6. The extension device of claim 5 wherein said cable is connected between said horizontal platform and said first rolling support means of the rowing exercise machine.

7. The extension device of claim 1 wherein said ground-engaging rolling means comprises wheels which are located rearwardly of the rail of the rowing exercise machine when the extension device is attached to the rowing exercise machine and the seat is moved to its rearmost position on the rail.

8. The extension device of claim 1 further including a safety cable which has one end attached in fixed relation to said horizontal platform and the other end attached to the rowing exercise machine in fixed relation to the rail of said rowing exercise machine.

9. The extension device of claim 1 wherein said horizontal platform is sized and positioned to support the upper body and the head of an adult person fully reclining from the seat of the rowing exercise machine.

10. In a rowing exercise machine including a rail, a foot rest supported in fixed relation to said rail, a seat, and rolling support means supporting said seat for movement longitudinally along said rail forwardly toward said foot rest and rearwardly therefrom, the improvement comprising:

a horizontal platform distinct from said seat and having a forward portion and a terminal portion longitudinally spaced from said forward portion rearwardly of said rail;

means to affix said forward portion of said horizontal platform adjacent to and behind said seat for movement in concert with said seat;

roller means, separate from said rolling support means supporting said seat, for supporting said forward portion of said horizontal platform to move on said rail; and ground-engaging rolling means affixed to said terminal portion of said horizontal platform, further allowing said horizontal platform to move in concert with said seat, and wherein said horizontal platform is sized to support the upper body and the head of an adult person fully reclining rearwardly from said seat.

11. The improvement of claim 10 wherein the affixing means comprises a cable which secures said horizontal platform adjacent to said seat.

* * * * *